US005386280A

United States Patent [19]

Nishikawa

[11] Patent Number: 5,386,280

[45] Date of Patent: Jan. 31, 1995

[54] ELECTROPHOTOGRAPHIC IMAGING APPARATUS WITH CONTINUOUS FORM FEEDER LOCATED AFTER FIXING DEVICE

[75] Inventor: Tomoyuki Nishikawa, Matsudo, Japan

[73] Assignee: Asahi Kogaku Kogyo Kabushiki Kaisha, Tokyo, Japan

[21] Appl. No.: 775,902

[22] Filed: Oct. 15, 1991

[30] Foreign Application Priority Data

Oct. 13, 1990 [JP] Japan ..... 2-274198

[51] Int. Cl.[6] ..... G03G 15/20

[52] U.S. Cl. ..... 355/282; 226/74; 355/285

[58] Field of Search ..... 355/282, 285, 309, 321; 226/74; 400/569, 611, 616.1, 692, 625; 427/194, 444

[56] References Cited

U.S. PATENT DOCUMENTS

| | | | |
|---|---|---|---|
| 3,618,514 | 1/1971 | Nyman et al. | 101/936 |
| 3,661,453 | 5/1972 | McGuire et al. | 355/319 |
| 4,218,499 | 8/1980 | Shinohara et al. | 427/444 |
| 4,789,259 | 12/1988 | Katayanagi | 400/624 |
| 4,814,825 | 3/1989 | Johdai et al. | 271/186 X |
| 4,929,982 | 5/1990 | Ainoya et al. | 355/311 |
| 4,943,863 | 7/1990 | Ainoya | 355/271 |
| 4,948,282 | 8/1990 | Koike et al. | 400/616.2 |
| 5,016,029 | 5/1991 | Mori et al. | 346/160 |
| 5,017,943 | 5/1991 | Ogita et al. | 226/24 X |
| 5,019,872 | 5/1991 | Zajac, Jr. | 355/317 |
| 5,028,156 | 7/1991 | Takano | 400/625 |
| 5,108,210 | 4/1992 | Hirano et al. | 400/616.1 |
| 5,121,867 | 6/1992 | Aoyama et al. | 226/101 |

FOREIGN PATENT DOCUMENTS

| | | | |
|---|---|---|---|
| 0157263 | 9/1982 | Japan | 355/321 |

*Primary Examiner*—Leo P. Picard
*Assistant Examiner*—Christopher Horgan
*Attorney, Agent, or Firm*—Sandler Greenblum & Bernstein

[57] ABSTRACT

An electrophotographic imaging apparatus using a continuous form recording sheet is provided, in which the recording sheet carrying an unfixed toner image is passed through a fixing device and the toner image is fixed thereon. The imaging apparatus includes a recording sheet transporting device, disposed on the downstream side of the fixing device, to ensure that the recording sheet is stably transported and discharged from the imaging apparatus.

13 Claims, 5 Drawing Sheets

ELECTROPHOTOGRAPHIC IMAGING APPARATUS WITH CONTINUOUS FORM FEEDER LOCATED AFTER FIXING DEVICE

BACKGROUND OF THE INVENTION

The present invention relates to an electrophotographic imaging device using a continuous form recording sheet.

Conventionally, an electrophotographic imaging apparatus, such as, a electronic copy machine, a laser beam printer and the like, is known wherein the uniformly charged surface of a photoconductive drum is exposed to light to form a latent image, toner is adhered to the latent image to develop a toner image, and the toner image is transferred to a recording sheet and fixed thereon by a fixing unit.

In general, a laser beam printer of this kind uses a so-called cut sheet which is cut into a predetermined size as a recording sheet, and a so-called heat roll fixing unit is employed therein as a fixing unit. The heat roll fixing unit comprises a pair of fixing rollers composed of a heat roller heated to a high temperature and a backup roller (also referred to a press roller) pressed against the heat roller. The recording sheet on which a unfixed toner image is placed passes between the rollers, and then the toner is heated and pressed so that the toner image is fused and adhered on the recording sheet.

The heat roller is composed of a cylindrical roller having a heating element such as a halogen lamp or the like inserted therein and heated to a predetermined temperature. The press roller is formed of a material such as silicone rubber or the like having a heat resistant property and a predetermined elasticity and pressed against the heat roller by a predetermined pressure.

A recording sheet on which unfixed toner is placed is passed between the pair of the fixing rollers to heat the toner and press so that the toner is melted and fixed on the recording sheet. This kind of the heat roll fixing unit is advantageous in that it has an excellent heat efficiency and can be operated at a high speed.

Further, another fixing method can also be employed wherein a recording sheet is only pressed by being held between rollers pressed against the other roller so that toner is crushed by the pressure and fixed. This type of unit is known a as a pressure fixing unit.

In the heat roll fixing or pressure fixing as described above, one of the rollers, which is pressed against the other roller, is rotated and thus a recording sheet held between the pair of the fixing rollers is fed by the fixing unit. In the case of the heat roll fixing, the heat roller is usually rotated and the press roller is driven to rotate by the heat roller.

Nevertheless, in the arrangement wherein a fixing operation is carried out in such a manner that a recording sheet is held between the rollers, one of which is pressed against the other and pressed (and heated) as well as the recording sheet is fed by rotating one of the rollers, a problem arises in that a feed speed of the recording sheet is changed by the difference of a friction coefficient on the surface of the recording sheet.

More specifically, a roller (heat roller in the case of the heat roll fixing) in contact with an image carrying surface is usually driven to rotate, and the surface of the roller is finished to have a lower friction coefficient so that the toner is not adhered thereon. Therefore, the roller to be rotated may slip on the surface of the recording sheet to disturb the image and lower a feed force. Further, if the surface of the recording sheet has a very low friction coefficient, the recording sheet cannot be fed. In particular, in the case that labels or the like are discontinuously attached on a release paper, the friction coefficient of the release paper changes depending upon the portion thereof and thus the feed speed of the paper is greatly changed.

Moreover, when a continuous recording sheet or the like is used as a recording sheet and another sheet feed means is used besides the heat roll fixing unit, the recording sheet feed speeds of both feed means may not be synchronized due to the change of the feed speed as described above and thus the recording sheet is loosened or jammed.

Further, a feed speed of the recording sheet should be completely synchronized with the circumferential speed of a photoconductive drum. If the recording sheet is a continuous recording sheet or the like and no sheet feed means is provided except the fixing unit, since the feed of the recording sheet depends upon the fixing unit, an image is defectively transferred by the change of the feed speed.

SUMMARY OF THE INVENTION

It is therefore an object of the present invention to provide an electrophotographic imaging apparatus using a continuous form recording sheet with which a recording sheet, even having a low frictional surface, can be stably fed, printing is not disturbed, and the recording sheet is not defectively fed.

For the above object, according to the present invention, there is provided an electrophotographic imaging apparatus using a continuous form recording sheet, comprising a mechanism for transporting the continuous recording sheet disposed on the paper discharge side of a fixing device.

Optionally, the transporting mechanism is arranged to be detachable.

Further, the fixing device is a heat roll fixing device.

Furthermore, the recording sheet is neutrally fed by the fixing device, and the speed at which the transporting mechanism drive the recording sheet is set higher than the speed at which the recording sheet is driven by the fixing device.

According to another aspect of the invention, there is provided a sheet transportation device to be detachably mounted on an electrophotographic imaging apparatus using a continuous form recording sheet, comprising a frame member, a sheet transporting mechanism mounted on the frame member, and mechanism for coupling the frame member to the imaging apparatus, whereby the continuous form recording sheet is transported by the sheet transporting mechanism when coupled to the imaging apparatus.

Optionally, the imaging apparatus has a discharge port from which the recording sheet having a fixed image thereon is discharged, and wherein the sheet transportation device is coupled to the imaging device at the discharge port.

DESCRIPTION OF THE ACCOMPANYING DRAWINGS

DESCRIPTION OF THE EMBODIMENTS

Figure 1:
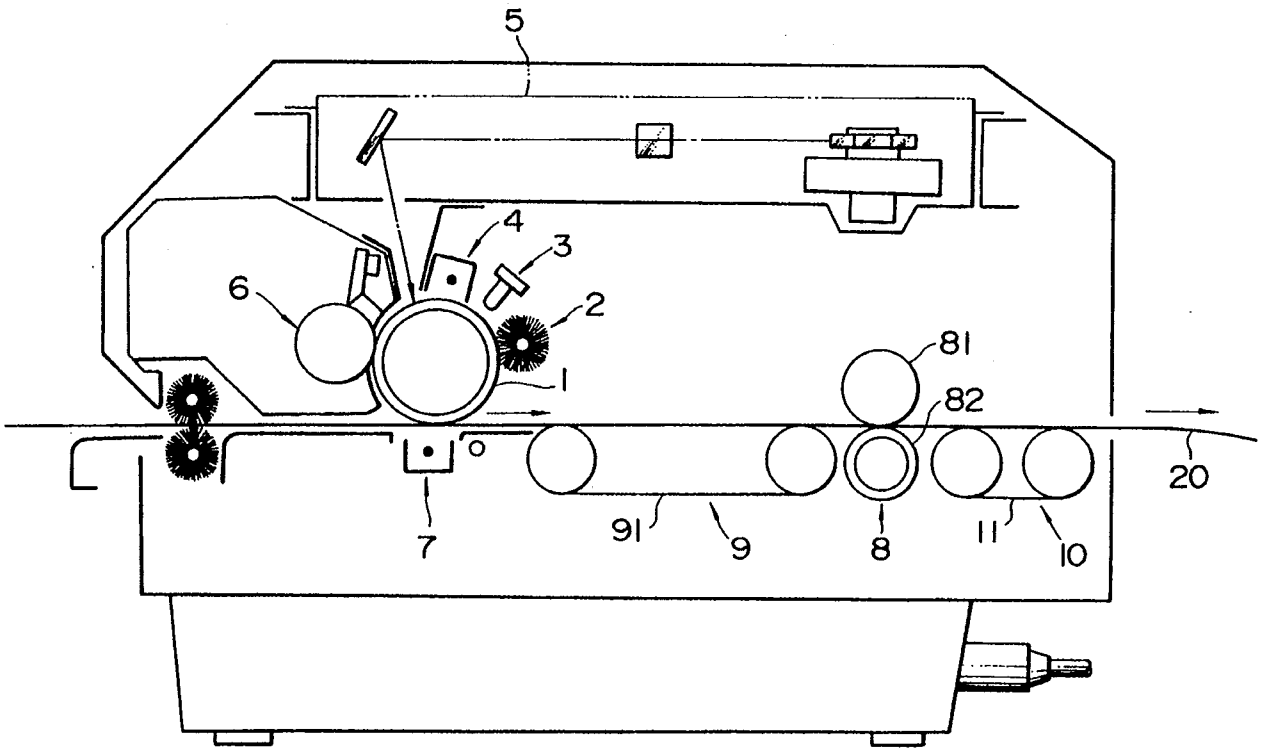
FIG. 1 is a schematic cross-sectional view of an arrangement of a laser beam printer as a first embodiment of the present invention.

FIG. 1 is a schematic cross sectional view of an arrangement of a laser beam printer in accordance with a first embodiment of the present invention.

The laser beam printing apparatus shown in FIG. 1 prints an image data or character data input from a computer onto a fanfold sheet 20 as a continuous recording sheet with use of an electrophotographic image forming method, and outputs the same as a hard copy.

A photoconductive drum 1 is rotated by a not shown main motor at a predetermined circumferential speed. A toner cleaner 2, a discharging unit 3, a charging unit 4, a scanning optical system 5 (i.e., a scanning/exposing mechanism) by which a laser beam is introduced onto the charged surface of the photoconductive drum 1, a developing unit 6 and a transfer unit 7 are disposed around the periphery of the photoconductive drum 1 along the rotating direction thereof.

A recording sheet feed path is substantially horizontally arranged on the right and left sides of the transfer unit 7 which is disposed substantially downward of the photoconductive drum 1, a tensioning mechanism 9 is disposed along the recording sheet feed path on the paper discharge side (right side) of the transfer unit 7, a fixing unit 8 is disposed on the paper discharge side of the tensioning mechanism 9, and further a tractor 10 (i.e., a recording sheet driving mechanism) is disposed at the paper discharge side of the fixing unit 8. Note that in the first embodiment of the present invention a fanfold sheet 20 is fundamentally driven to feed by the fixing unit 8.

The tensioning mechanism 9 comprises two endless belts 91 arranged in parallel and corresponding to the feed holes location of the fanfold sheet 20. Each of the endless belts 91 has projections to be engaged with the feed holes defined along the side ends of the fanfold sheet 20. Since one of the pulleys is coupled to a not shown drive motor through an one way clutch, the endless belts 91 are driven by the drive motor in the feed direction of the fanfold sheet 20 at a speed a little (by 1 to 2%) slower than the feed speed of the fixing unit 8, and the endless belts 91 also can be idly rotated with a predetermined resistance in the sheet feed without being driven by the drive motor.

As the fanfold sheet 20 is fed by the fixing unit 8, the endless belts 91 are rotated with the predetermined resistance without being driven by the drive motor. Thus the endless belts 91 apply a tension to the fanfold sheet 20 between the tensioning mechanism 9 and the fixing unit 8 so that the resistance prevents the fanfold sheet 20 from being skewed.

Figure 2:
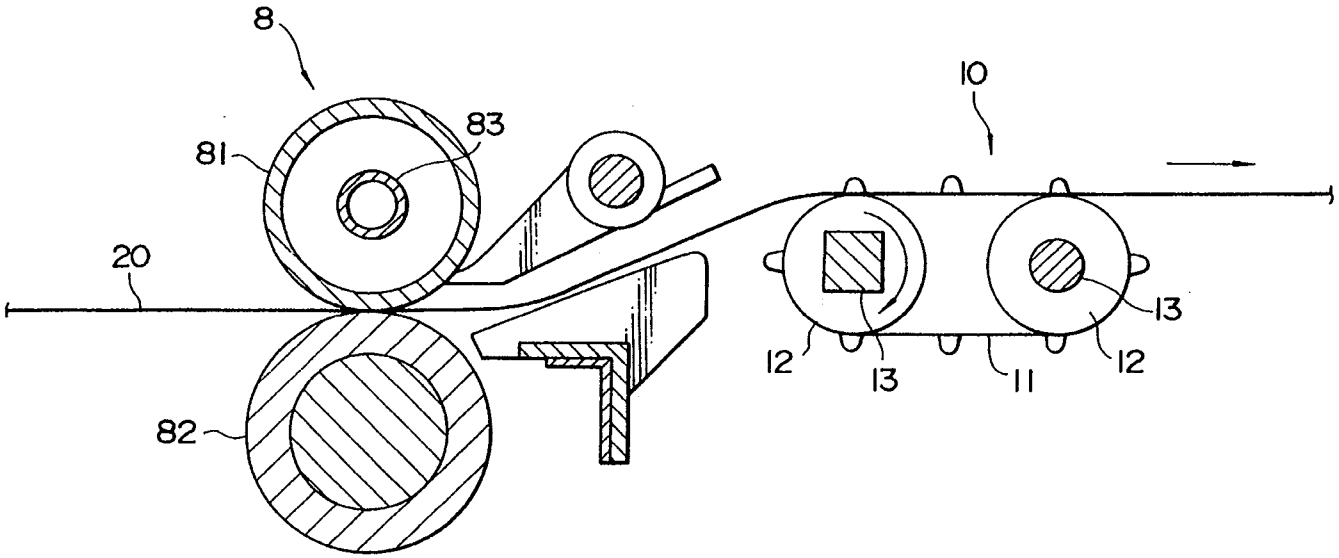
FIG. 2 is an enlarged cross sectional view of a fixing unit and a sheet feed mechanism according to the present invention.
Figure 3:
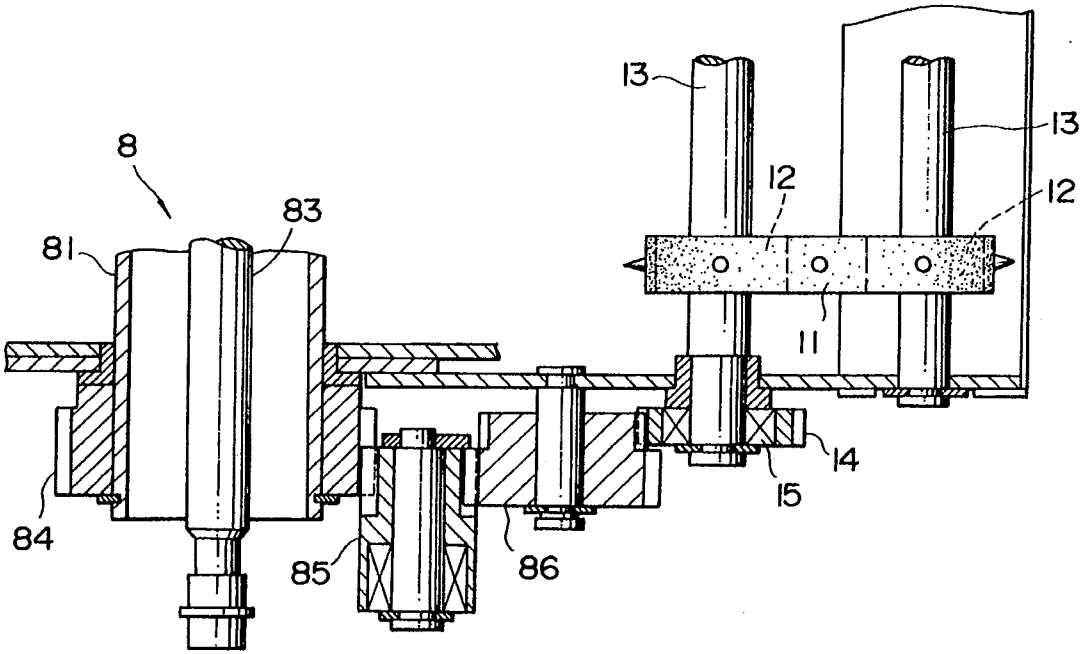
FIG. 3 is a cross sectional view showing the drive force transmit system.

As shown in an enlarged cross sectional view of FIG. 2, the fixing unit 8 is arranged such that a pair of fixing rollers (a heat roller 81 and a press roller 82) are disposed perpendicularly to the feed direction of the fanfold sheet 20. One of the fixing rollers 81, 82 is pressed against the other roller. The heat roller 81 is a cylindrical roller having a halogen lamp 83 as a heating element disposed therein, and heated by the halogen lamp 83 to a predetermined temperature. The heat roller 81 is driven by a not shown drive mechanism through a gear 84 (shown in FIG. 3), which is fixed to a side end thereof, at the same circumferential speed as that of the photoconductive drum 1.

Similarly to the above tensioning mechanism 9, a tractor 10 comprises two endless belts 11 arranged in parallel around a pair of pulleys and corresponding to the feed hole locations of the fanfold sheet 20. Each of the endless belts 11 has projections to be engaged with feed holes defined along the side end of the fanfold sheet 20. The endless belts 11 are driven together in such a manner that the gear 14, which is fixed at an end of the shaft 13 on which a pulley 12 associating with the endless belts 11 is mounted, is meshed with the gear 84 fixed to a side ends of the heat roller 81 through idle gears 85 and 86.

It seems to be sufficient that peripheral speed of the endless belts 11 have the same speed as the circumferential speed of the fixing unit 8. If, however, the peripheral speed of the endless belts 11 becomes slower than the feed speed of the fanfold sheet 20 by the accumulated speed error, etc., a disadvantage such as a paper jam and the like arises. Accordingly, the one way clutch 15, which can idly run in the feed direction of the fanfold sheet 20, is interposed between the shaft 13 and the gear 14 (see FIG. 3). With this arrangement, when the feed speed of the fanfold sheet 20 becomes higher than the circumferential speed of the endless belts 11, the difference of the speeds can be compensated by the one way clutch 15.

Further, the peripheral speed of the endless belts 11 may be set a little (by 1 to 24) higher than the feed speed of the fanfold sheet 20 and a torque limiter may be interposed instead of the above one way clutch 15. In this case, a torque value is set to such a range between a value at which the fanfold sheet 20 which slips at the fixing unit can be fed at a normal (specific) speed and a value at which feeding of a fanfold sheet 20 which can be fed at a normal speed by the fixing unit 8 is not disturbed.

Accordingly, the laser beam printer arranged as described above performing a main scanning (exposing the charged surface of the photoconductive drum with laser beam) and an auxiliary scan is performed (the photoconductive drum is rotated). Then the latent image formed on the circumferential surface of the photoconductive drum 1 is developed into a toner image in the developing unit 6. The toner image is transferred onto the fanfold sheet 20 fed by the fixing unit 8, and the toner image on the fanfold sheet 20 is fixed by the fixing unit 8, and then the fanfold sheet 20 is discharged from the printer via the tractor 10.

As described above, the fanfold sheet 20 is fundamentally fed by the fixing unit 8 at the same feed speed as the circumferential speed of the photoconductive drum 1. Even if the fanfold sheet 20 has a low friction coefficient on the surface thereof and thus the heat roller 81 and backup roller 82 of the fixing unit 8 slip on the surface of the fanfold sheet 20 and reduce the feed capability of the fixing unit 8, the fanfold sheet 20 can be stably driven by the assistance of the tractor 10 disposed on the downstream side of the fixing unit 8. Therefore, even if an image is formed on the fanfold sheet 20 the surface of which has a low friction coefficient or on the fanfold sheet 20 composed of a release paper the friction coefficient of which is changed depending upon the portion thereof where labels are discontinuously attached, printing is not disturbed and the recording sheet is not loosened or jammed because the feed speed does not change.

Figure 4:
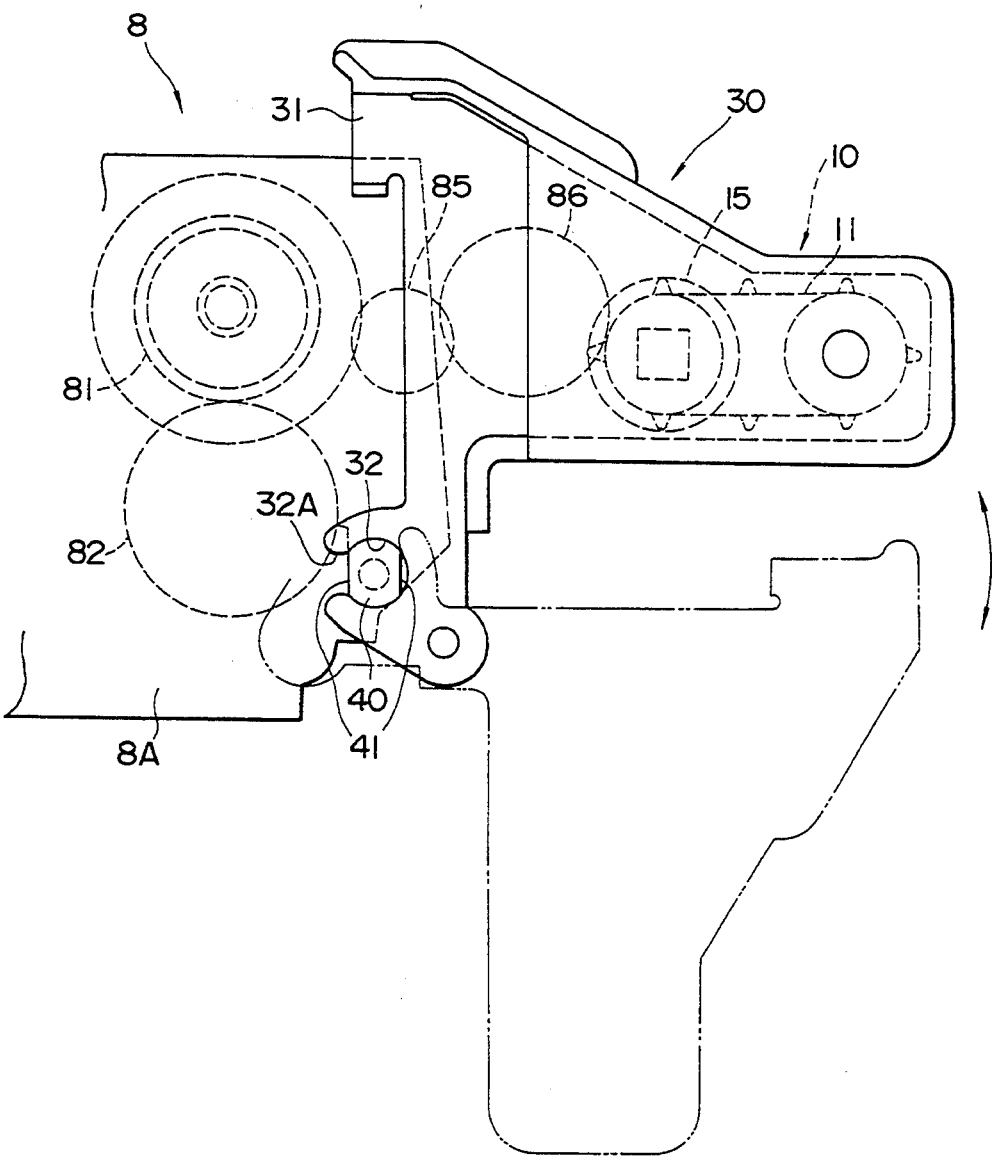
FIG. 4 is a partial side view showing a second embodiment of the present invention.

Note, although the above first embodiment has the tractor 10 fixed on the paper discharge side of the fixing unit 8, the tractor 10 may be arranged as a unit so that it can be detachably mounted and selectively used depending upon the quality of the fanfold sheet 20. FIG. 4 shows the above-said tractor unit as a second embodiment of the invention.

More specifically, for example, as shown in FIG. 4, pins 40 having parallel cutout surfaces 41 defined in the upper and lower directions thereof are fixed in the opposite sides of the chassis 8A of the fixing unit, slits 32A, which are narrower than the diameter of the pin 40 and wider than the thickness between the cutout surfaces 41 (can pass the pin 40 in the direction of the parallel surfaces 41), are defined in front of engaging holes 32 to be engaged with the pins 40 of the unit frame 31 of a tractor unit 30, the engaging holes 32 are engaged with the pins 40 through the slits 32A in the state that the tractor unit 30 is swung backward by 90 degrees, as shown by an imaginary line in FIG. 4, and then the tractor unit 30 is swung forward by 90 degrees and fixed at the predetermined position where the idle gear 85 is meshed with the idle gear 86.

With this arrangement, when the fanfold sheet 20 has a high friction coefficient on the surface thereof and can be stably fed by the fixing unit 8, the tractor unit 30 is dismounted to provide a necessary minimum arrangement, which contributes to the reduction in size and a room for the printer.

Figure 5:
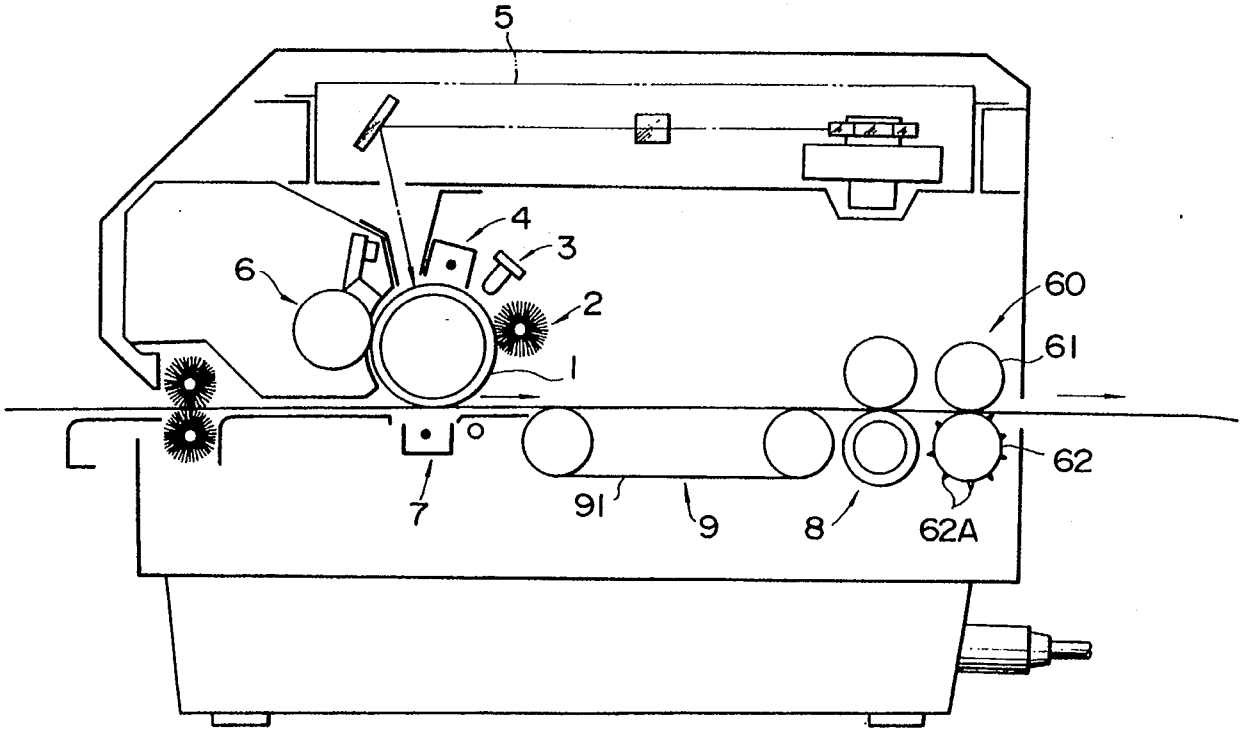
FIG. 5 is a cross sectional view of a laser beam printer according to a third embodiment of the present invention.

The recording sheet driving mechanism disposed on the downstream side of the fixing unit 8 is not limited to the above tractor belt, but may be rollers as shown in FIG. 5.

A pair of rollers 60 as a third embodiment of the present invention shown in FIG. 5 is composed of a rubber roller 61 having a smooth surface and a wart roller 62 having a plurality of projections on the circumferential surface thereof and pressed against the rubber roller 61 from the lower side thereof. The wart roller 62 is capable of being rotated and has a circumferential speed set to a little (by 1 to 2%) higher than the feed speed of the fanfold sheet 20 fed by the fixing unit 8. With this arrangement, since the rubber projections 62A of the wart roller 62 are abutted against the fanfold sheet 20 and thus the fanfold sheet 20 receives a high surface pressure, the fanfold sheet 20 can be securely and stably driven. In addition, a difference between the circumferential speed of the wart roller 62 and the feed speed of the fanfold sheet 20 fed by the fixing unit 8 can be compensated by the deformation of the rubber projections 62A.

According to the electrophotographic printer using a continuous recording sheet described above, even if a recording sheet has a low frictional surface, it can be stably transported, whereby a printing disturbance and defective feed of paper can be prevented.

Further, since the recording sheet drive mechanism disposed on the paper discharge side of the fixing unit can be detachable, the printing apparatus can be arranged to a necessary minimum size depending upon a recording sheet used, which contributes to the reduction in size and room for the printing apparatus.

The present disclosure relates to subject matter contained in Japanese patent application No. HEI 2-274198 (filed on Oct. 13, 1990), which is expressly incorporated herein by reference in its entirety.

What is claimed is:

1. An electrophotographic imaging apparatus using a continuous form recording sheet, comprising:

a fixing device for fixing an image formed on said continuous sheet to said continuous sheet, said fixing device comprising a pair of rollers for feeding said continuous sheet through a nip formed therebetween;

means defining a paper discharge side located on a downstream side of said fixing device;

means for feeding said continuous sheet towards said fixing device at a first predetermined speed; and means for transporting said continuous sheet fed from said fixing device at a second predetermined speed, said transporting means being disposed on the paper discharge side of said fixing device, said second predetermined speed being substantially equal to a speed of said pair of rollers.

2. The electrophotographic imaging apparatus according to claim 1, wherein said transporting means is arranged to be detachable.

3. The electrophotographic imaging apparatus according to claim 1, wherein at least one of said pair of rollers is driven to rotate, the other one of said pair of rollers being driven by said one of said pair of rollers to rotate, said transporting means comprising a transmittal gear train for transmitting a rotational force of said one of said pair of rollers.

4. The electrophotographic imaging apparatus according to claim 3, wherein said continuous form recording sheet comprises feed holes at both side end portions thereof, said transporting means further comprising:

a pair of endless belts; and a pair of pulleys provided at a position corresponding to each side end of said recording sheet, wherein each of said endless belts is arranged around said pair of pulleys, each of said endless belts having projections corresponding to said feed holes of said recording sheet to be engaged therewith, at least one of said pair of pulleys being driven to rotate so that said recording sheet is transported in the same direction as said fixing device feeds said recording sheet.

5. The electrophotographic imaging apparatus according to claim 1, wherein said transporting means comprises a pair of transport rollers, said pair of transport rollers being pressed against each other, one of said pair of transport rollers being a wart roller comprising a plurality of elastic projections.

6. The electrophotographic imaging apparatus according to claim 1, wherein said fixing device is a heat roll fixing device.

7. An apparatus for transferring an image to a continuous form recording sheet transported along a feed path, comprising:

a fixing device for fixing an image formed on said continuous sheet to said continuous sheet, said fixing device comprising a pair of rollers for feeding said continuous sheet through a nip formed therebetween;

first feeding means, disposed on an upstream side of said fixing device, for transporting said continuous sheet along the feeding path at a first predetermined speed; and second feeding means, disposed on a downstream side of said fixing device, for transporting said continuous sheet along the feeding path at a second predetermined speed, said second predetermined speed being substantially equal to a speed of said pair of rollers.

8. The imaging apparatus according to claim 7, wherein said second predetermined speed is higher than said first predetermined speed so that said continuous sheet is stably fed.

9. The apparatus according to claim 7, wherein said second feeding means is detachably coupled to the imaging apparatus.

10. The apparatus according to claim 7, further comprising drive means for providing a driving force and transmitting means for transmitting the driving force of said drive means to at least said second feeding means.

11. The electrophotographic imaging apparatus according to claim 1, wherein said second predetermined speed is higher than said first predetermined speed.

12. The electrophotographic imaging apparatus according to claim 1, wherein said continuous sheet is fed in a single direction along a sheet feeding path by said feeding means.

13. The apparatus according to claim 9, wherein said continuous sheet is fed in a single direction along said feeding path by said first feeding means.

* * * * *

UNITED STATES PATENT AND TRADEMARK OFFICE

CERTIFICATE OF CORRECTION

PATENT NO. : 5,386,280

DATED : January 31, 1995

INVENTOR(S) : Tomoyuki NISHIKAWA

It is certified that error appears in the above-indentified patent and that said Letters Patent is hereby corrected as shown below:

On the cover sheet, in section [56], line 1 under U.S. PATENT DOCUMENTS, change "1/1971" to ---11/1971---.

At column 8, line 12 (claim 13, line 1), change "claim 9" to --- claim 7---.

Signed and Sealed this

Twenty-seventh Day of June, 1995

*Attest:*

Bruce Lehman

BRUCE LEHMAN

*Attesting Officer*

*Commissioner of Patents and Trademarks*